US006804833B2

(12) United States Patent
Bertola

(10) Patent No.: US 6,804,833 B2
(45) Date of Patent: Oct. 19, 2004

(54) DISPOSABLE GARMENT OF THE "SINGLE USE" TYPE

(76) Inventor: Anna Maria Bertola, via Borgo S. Marco, 1 - 24040 Ciserano (Bergamo) (IT)

( * ) Notice: Subject to any disclaimer, the term of this patent is extended or adjusted under 35 U.S.C. 154(b) by 0 days.

(21) Appl. No.: 09/863,924

(22) Filed: May 23, 2001

(65) Prior Publication Data

US 2002/0002846 A1 Jan. 10, 2002

(30) Foreign Application Priority Data

Feb. 6, 2000 (IT) ..... MI20000340 U

(51) Int. Cl.[7] ..... A41D 1/00
(52) U.S. Cl. ..... 2/243.1; 2/400
(58) Field of Search ..... 2/400–408, 227–228, 2/238, 69, 114, 113, 115, 78.1–78.3, 102, 106, 76, 73, 275; 450/1, 60–75, 86, 92; 66/1.71, 172 R, 173, 175–177, 153, 172 E, 169 R, 189, 174, 196, 198

(56) References Cited

U.S. PATENT DOCUMENTS

| | | | | | |
|---|---|---|---|---|---|
| 2,000,073 | A | * | 5/1935 | Goas | 2/400 |
| 2,285,012 | A | * | 6/1942 | Burkey | 2/400 |
| 2,833,134 | A | * | 5/1958 | Gift | 2/400 |
| 3,375,530 | A | * | 4/1968 | Matthews et al. | 2/400 |
| 3,491,375 | A | * | 1/1970 | Beard et al. | 2/400 |
| 4,133,054 | A | * | 1/1979 | Harper | 2/407 |
| 4,302,853 | A | * | 12/1981 | Mesek | 2/402 |
| 4,736,468 | A | * | 4/1988 | Efird et al. | 2/400 |
| 5,592,836 | A | * | 1/1997 | Schuster et al. | 66/176 |
| 5,605,060 | A | * | 2/1997 | Osborne | 66/171 |
| 6,178,784 | B1 | * | 1/2001 | Marley, Jr. | 66/173 |

* cited by examiner

*Primary Examiner*—Gloria M. Hale
(74) *Attorney, Agent, or Firm*—Abelman, Frayne & Schwab

(57) ABSTRACT

A disposable garment of the "single use" type, obtained by cutting and sewing a tubular woven fabric, consisting of at least two tubular woven fabrics for seamless stockings, cut and open along one side (20), superposed to one another and sewn along the edges of the open side (20).

6 Claims, 2 Drawing Sheets

DISPOSABLE GARMENT OF THE "SINGLE USE" TYPE

BACKGROUND OF THE INVENTION

1. Field of the Invention

The present invention relates to a disposable garment of the "single use" type. More particularly, the present invention relates to a disposable garment of the "single use" type made of knitted fabric, preferably obtained from synthetic or artificial fibers.

2. Description of the Related Art

The term "garment" as used in third description and in the claims, comprises any piece of garment to wear, both underwear to be worn directly in contact with the skin like undershirts, pants, panties, briefs, shirts, culottes, vests, bathing suits, tops, body stocking, etc. and non-underwear like beach robes, bathing caps, jerseys with or without sleeves, etc.

There exist, as is known, disposable underwear articles that are utilized especially by chance in situations wherein it is impossible or uncomfortable to wash said underwear articles, situations of this type occur, for instance, during travels or long transfers.

The necessity of frequently replacing underwear is on the other hand essential for health and comfort reasons and is still more felt in hot climate periods Said garments or underwear articles are obtained from paper or from the so-called nonwoven fabrics. Said garments, though commonly used, are not without drawbacks principally related to the comfort. They are in fact little comfortable for users because of the material they are made from, especially so in the case of the underwear articles directly in contact with the skin like panties, briefs, culottes, body stocking, etc. Nonwoven fabrics, and especially paper, have characteristics of poor conformability to the body and of substantial rigidity. The underwear articles obtained from these materials, beside the direct discomfort due to these factors, can also cause skin irritations, even if they are not continuously worn.

The garments cut from tubular knitted fabrics manufactured on looms or knitting machines and having a diameter greater or equal to that of the garment to be obtained are also known and commonly used. Said tubular knitted fabrics are cut in order to obtain the different parts forming the garment and are then sent to the tailoring, i.e. to the sewing.

The cost of said garments prevents them to be of the "single use" type, that is to be worn only once and get rid of.

Object of this invention is to obviate the above draw, backs.

More particularly, object of this invention is to realize a garment of the "single use" type suitable to ensure an adequate comfort for users, just as a traditional and washable underwear article.

Another object of the invention is to realize a garment as defined above, suitable to ensure a high level of comfort and resistance, and also such as to be easily and economically realized.

In its more general aspect the present invention permits to achieve these and other objects that will result from the following description thanks to the use of a tubular knitted fabric obtained by superimposing at least two tubular knitted fabrics for seamless stockings open on one side and coupling them by sewing the opposite sides.

The tubular knitted fabric thus obtained is then sent to the final tailoring comprising the sewing and cutting in order to realize the shape of the garment.

The scope of the present invention is thus a disposable garment of the "single use" type, obtained by cutting and sewing a tubular knitted fabric, in which said fabric is formed by at least two tubular knitted fabrics for seamless stockings, open on one side, superposed to one another and sewn along the edges of the open side.

The tubular knitted fabrics for seamless stockings are produced on circular machines with small diameter latch needles, generally known as "stockings round-machines".

Such circular machines for seamless stockings may be of any known type, we mention, by way of example: tubular machines with two zones of latch needles; tubular machines with two zones of latch needles, tubular machines with only one zone and only one cylinder of vertical latch needles; double cylinder tubular machines with double bill latch needles, etc.

The yarn used for the production of said tubular knitted fabrics for seamless stockings is not critical, though artificial or synthetic fibers are preferred. The polyamide fiber generally known as "nylon" is particularly preferred.

BRIEF DESCRIPTION OF THE DRAWINGS

In order to better understand the structure and the production process of the disposable garment of this invention, said garment will be specified in the following description wherein reference is made to the attached drawings which represent some preferred exemplifying but non-limiting embodiments thereof, and wherein.

DETAILED DESCRIPTION OF THE PREFERRED EMBODIMENTS

Figure 3:
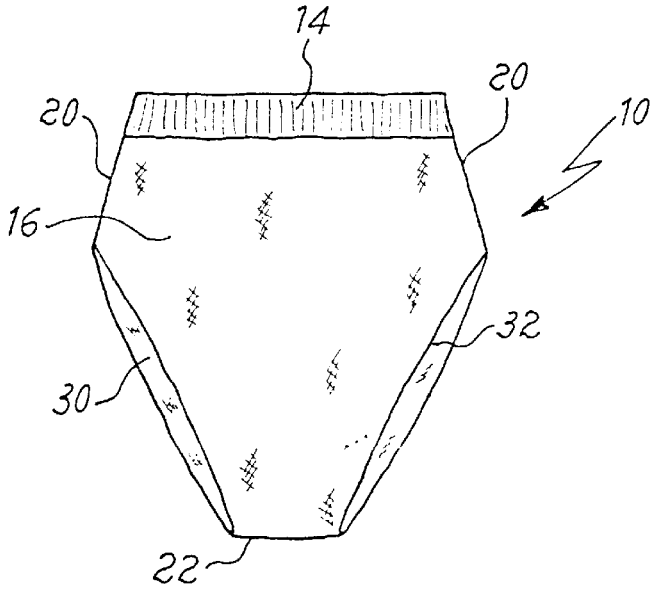
FIG. 3 shows the schematic front view of the garment obtained from the tubular knitted fabric of FIG. 2.

With reference to said figures, the disposable garment of the present invention with reference to a production process of a panty or a brief indicated as a whole by 10 in FIG. 3, through the same process may be applied with equal efficacy to any other garment. The panty 10 is obtained from a tubular knitted fabric 12 for seamless stockings, preferably nylon, the length of which is adequate to the size or measure of the garment to be obtained.

The upper open edge of the tubular knitted fabric 12 for seamless stockings is preferably folded on itself to a limited extent and is sewn to form, given the elasticity of the material, a curliness 14. Said curliness constitutes the upper band that wraps around the waist of the user.

Figure 1:
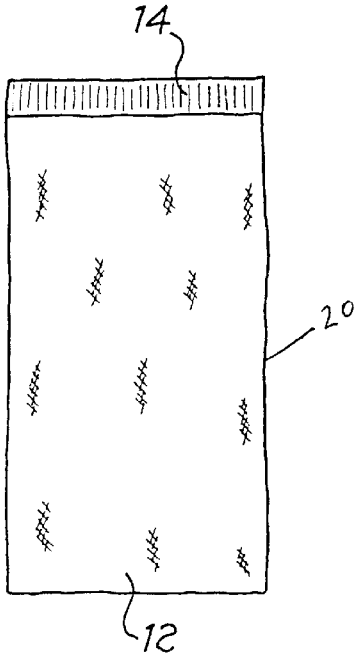
FIG. 1 shows a schematic view of the tubular knitted fabric for seamless stockings used to obtain the garment subject matter of the invention.
Figure 2:
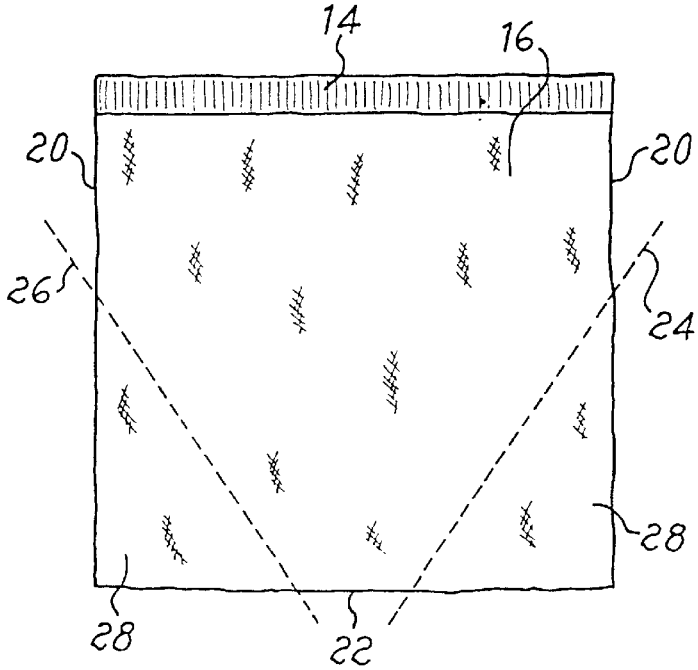
FIG. 2 shows a schematic front view of the tubular knitted fabric for seamless stockings open on one side and coupled with another similar fabric, showing the cutting and shaping lines making up the garment of the invention.

In the preparation of the garment 10 two like tubular knitted fabrics 12 for seamless stockings are used, each of which is cut along one of the vertical edges 20 in such a way as to obtain a panel of straight fabric like the one indicated by 16 in FIG. 2. The two open and straight tubular elements are superposed to one another, coupled and sewn in a known manner along the vertical edges 20 and the base 22 opposed to the upper edge, folded and curled, 14.

Stitches are also provided along diagonal lines 24, 26 on each panel to define the conventional profile of the panties or briefs. Parts 28 of excess fabric, external with respect to the diagonal lines 24, 26 are trimmed by means of cutters, thus forming at the same time the opposite openings 30, 32 for the legs.

The garment 10 obtained has, thanks to the material employed, characteristics of optimum softness, elasticity and conformability, and is particularly comfortable for the touch with the body.

Figure 4:
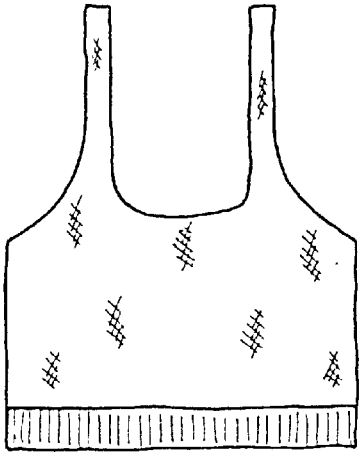
FIGS. 4, 5 and 6 show schematically as different models of the garments of the invention.
Figure 5:
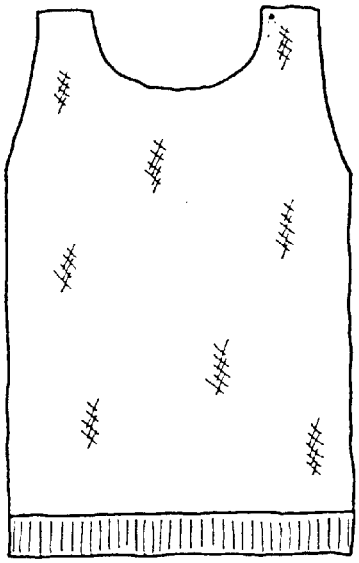

The invention has been described hereinabove with reference to the production of panties or briefs. It is however understood that the garment may have a different shape from that of panties or briefs, for instance that of a brassiere of the "top" type or a sleeveless vest, as schematized in FIGS. 4 and 5. In these cases, the curled edge is located at the base of the garment whose configuration is obtained by means of seams and cuts oriented and developed differently with respect of those of said panties or briefs.

Figure 6:
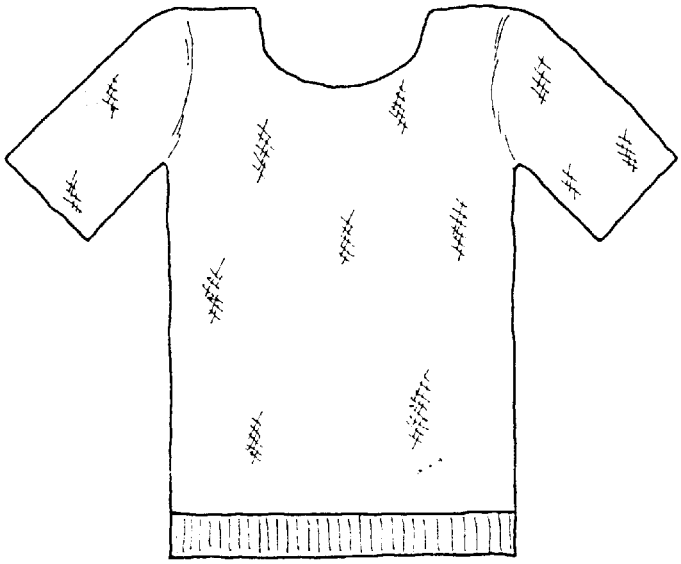

Additionally, as schematized in FIG. 6, the underwear garment may be constituted by a short-sleeved best or, possibly, by a long-sleeved vest. Said long or short sleeves are constituted by as many tubular elements cut out from the knitted fabric.

Besides, even though the use of polyamide fibers is preferred for the manufacture of the tubular knitted fabric for seamless stocking, the use of other synthetic fibers cannot be excluded, such as for instance polyester fibers, or artificial fibers as cellulose acetate fibers or rayon fibers.

Though the present invention has been described hereinabove with reference to some specific articles, it is well evident that, based on the above description, the experts in this field will see the possibility of obtaining different modifications and variants. Thus the invention is susceptible to comprise any modification and variant, all of which fall anyhow within the spirit and the scope of the following claims.

What is claimed is:

1. A process for manufacturing a garment from a tubular knitted fabric for seamless stockings made from synthetic or artificial fibers, said process comprising the steps of:

a) knitting two like tubular fabrics for seamless stockings (12), each having a length adequate to the size of the garment;

b) cutting each of said two like knitted tubular fabrics (12) along one of the vertical edges (20);

c) opening each of said two cut like knitted tubular fabrics (12) to form a panel of straight fabric (16) having a base (22), an opposite upper edge and two vertical edges (20);

d) stitching each panel of straight fabrics (16) along at least two predetermined lines (24,26) to define the profile of the garment;

e) superposing said two like open panels of straight fabrics (16) to one another to form a coupled single pair of panels with each respective base (22), upper and vertical edges (20) superposed on each other;

f) sewing said two superposed panels of straight fabrics (16) along said cut edges (20) and along said base (22); and g) cutting at least parts (28) of the excess fabric external with respect to said predetermined lines (24,26) to obtain openings (30,32) having stitched edge circumferences.

2. The process according to claim 1, including the step of folding on itself the upper edge of each panel (16) and sewing it to form a perimetrically extended curliness (14).

3. The process according to claim 1, including knitting each tubular fabric with circular machines having latch needles.

4. The process according to claim 2, including knitting each tubular fabric with circular machines having latch needles.

5. The process according to claim 1, including obtaining each tubular knitted fabric from polyamide fibers.

6. A process for manufacturing a garment from a tubular knitted fabric for seamless stockings made from synthetic or artificial fibers, said process comprising the steps of:

a) knitting two like tubular fabrics for seamless stockings (12), each having a length adequate to the size of the garment;

b) cutting each of said two like knitted tubular fabrics (12) along one of the vertical edges (20);

c) opening each of said two cut like knitted tubular fabrics (12) to form a panel of straight fabric (16) having a base (22), an opposite upper edge and two vertical edges (20);

d) cutting at least parts (28) of the excess fabric external with respect to at least two predetermined lines (24,26) to define the profile of the garment and to obtain openings (30,32);

e) stitching each panel of straight fabrics (16) along at least two predetermined lines (24,26) to define the profile of the garment having openings (30,32) having stitched edge circumferences;

f) superposing said two like open panels of straight fabrics (16) to one another to form a coupled single pair of panels with each respective base (22), upper and vertical edges (20) superposed on each other; and g) sewing said two superposed panels of straight fabrics (16) along said cut edges (20) and along said base (22).

* * * * *